US011626084B2

(12) United States Patent
Lu et al.

(10) Patent No.: US 11,626,084 B2
(45) Date of Patent: Apr. 11, 2023

(54) ELECTRONIC DEVICE, DISPLAY METHOD, AND MACHINE-READABLE STORAGE MEDIUM FOR DETERMINING THE MARGIN OF A DISPLAY FOR OVERCLOCKING

(71) Applicant: Acer Incorporated, New Taipei (TW)

(72) Inventors: Jun-Liang Lu, New Taipei (TW); Hsin-Yu Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/580,981

(22) Filed: Jan. 21, 2022

(65) Prior Publication Data

US 2022/0246111 A1 Aug. 4, 2022

(30) Foreign Application Priority Data

Feb. 2, 2021 (TW) ..... 110103806

(51) Int. Cl.
*G09G 1/02* (2006.01)
*G09G 5/00* (2006.01)
*G09G 3/20* (2006.01)

(52) U.S. Cl.
CPC ..... *G09G 5/005* (2013.01); *G09G 3/20* (2013.01); *G09G 2320/0247* (2013.01); *G09G 2340/0435* (2013.01)

(58) Field of Classification Search
CPC .. G09G 5/005; G09G 3/20; G09G 2320/0247; G09G 2340/0435
USPC ..... 345/27
See application file for complete search history.

(56) References Cited

U.S. PATENT DOCUMENTS

2005/0246329 A1* 11/2005 Milirud ..... G06F 3/1438
2008/0316200 A1* 12/2008 Cook ..... G06F 3/1438 345/418
2011/0109792 A1* 5/2011 Montag ..... H04L 65/80 348/390.1
2019/0371262 A1* 12/2019 Koo ..... G09G 5/005
2020/0105177 A1* 4/2020 Choi ..... G09G 3/20
2020/0135146 A1* 4/2020 Lee ..... G09G 5/006

* cited by examiner

*Primary Examiner* — Jonathan M Blancha
(74) *Attorney, Agent, or Firm* — McClure, Qualey & Rodack, LLP

(57) ABSTRACT

An electronic device coupled to a display includes a graphics card and a processor. The graphics card reads the extended display identification data from the display. The processor determines, according to the extended display identification data, that the display is able to display a default resolution at a first refresh rate at most, and determines, according to the extended display identification data, whether the display device is able to display the default resolution at a second refresh rate that exceeds the first refresh rate. When it is determined that the display is able to display the default resolution at the second refresh rate, the processor adds the second refresh rate into the extended display identification data.

18 Claims, 3 Drawing Sheets

ELECTRONIC DEVICE, DISPLAY METHOD, AND MACHINE-READABLE STORAGE MEDIUM FOR DETERMINING THE MARGIN OF A DISPLAY FOR OVERCLOCKING

CROSS REFERENCE TO RELATED APPLICATIONS

This Application claims priority of Taiwan Patent Application No. 110103806, filed on Feb. 2, 2021, the entirety of which is incorporated by reference herein.

BACKGROUND OF THE INVENTION

Field of the Invention

The disclosure relates generally to electronic devices, display methods, and a machine-readable storage medium, and more particularly it relates to electronic devices, display methods, and a machine-readable storage medium for determining the margin of a display for overclocking so as to improve the refresh rate.

Description of the Related Art

Due to the update of the display hardware chip, i.e., the scalar, and the performance improvement of the display card, the refresh rate of a display in nowadays is gradually increasing. The refresh rate has gradually increased from the previous mainstream 60 Hz to 120 Hz, 144 Hz and 240 Hz. However, the impact of the refresh rate is mainly determined by the performance of the panel, the display hardware chip (i.e., the scalar), and the graphics card. These three components have different specifications to meet different levels of refresh rate and resolution.

Since the above three components will have some margin for overclocking, it is necessary to improve the performance of the panel, the display hardware chip, and the graphics card so as to provide the best visual experience for the user.

BRIEF SUMMARY OF THE INVENTION

Electronic devices, display methods, and a machine-readable storage medium are provided herein, which are able to determine the margin of the display capability of a display, thereby enhancing the user's visual experience. Therefore, the user can enjoy a better visual experience despite limited resources.

In an embodiment, an electronic device coupled to a display is provided, which comprises a graphics card and a processor. The graphics card reads extended display identification data of the display. The processor determines, according to the extended display identification data, that the display is able to display a default resolution at a first refresh rate at most and determining, according to the extended display identification data, whether the display is able to display the default resolution at a second refresh rate. The second refresh rate exceeds the first refresh rate. When it is determined that the display is able to display the default resolution at the second refresh rate, the processor adds the second refresh rate into the extended display identification data.

According to an embodiment of the invention, the extended display identification data is stored in a register of the display. After the processor adds the second refresh rate into the extended display identification data, the processor further writes the updated extended display identification data into the register.

According to an embodiment of the invention, the extended display identification data comprises the default resolution and a transmission bandwidth, and the processor calculates the second refresh rate using the transmission bandwidth and the default resolution and determines whether the second refresh rate exceeds the first refresh rate. When the second refresh rate exceeds the first refresh rate, the processor determines that the display is able to display the default resolution at the second refresh rate.

According to an embodiment of the invention, after the processor adds the second refresh rate into the extended display identification data, the processor further determines a level of the graphics card.

According to an embodiment of the invention, when it is determined that the graphics card is at an entry level, the processor hides the second refresh rate so that a user is not able to select the second refresh rate.

According to another embodiment of the invention, when it is determined that the graphics card is at an intermediate level, the processor displays the second refresh rate on the display for a user to select and activates an adaptive synchronization function.

According to another embodiment of the invention, when it is determined that the graphics card is at a high-end level, the processor displays the second refresh rate on the display for a user to select and deactivates an adaptive synchronization function.

According to an embodiment of the invention, the electronic device is a computer.

According to another embodiment of the invention, the electronic device is a game console.

In an embodiment, a display method adapted to a display is provided, which comprises using a graphics card to read extended display identification data of the display;

determining that the display is able to display a default resolution at a first refresh rate at most; determining, according to the extended display identification data, whether the display is able to display the default resolution at a second refresh rate, wherein the second refresh rate exceeds the first refresh rate; and when it is determined that the display is able to display the default resolution at the second refresh rate, adding the second refresh rate into the extended display identification data.

According to an embodiment of the invention, the extended display identification data is stored in a register of the display. After the step of adding the second refresh rate into the extended display identification data, the display method further comprises writing the updated extended display identification data into the register.

According to an embodiment of the invention, the extended display identification data comprises the default resolution, the first refresh rate, and a transmission bandwidth. The step of determining, according to the extended display identification data, whether the display is able to display the default resolution at the second refresh rate further comprises calculating the second refresh rate using the transmission bandwidth and the default resolution; determining whether the second refresh rate exceeds the first refresh rate; and when the second refresh rate exceeds the first refresh rate, determining that the display is able to display the default resolution at the second refresh rate.

According to an embodiment of the invention, after the step of adding the second refresh rate into the extended display identification data, the display method further comprises determining a level of the graphics card; and when it is determined that the graphics card is at an entry level, hiding the second refresh rate so that a user is not able to select the second refresh rate.

According to another embodiment of the invention, after the step of determining the level of the graphics card, the display method further comprises when it is determined that the graphics card is at an intermediate level, displaying the second refresh rate on the display for the user to select and activating an adaptive synchronization function.

According to another embodiment of the invention, after the step of determining the level of the graphics card, the display method further comprises when it is determined that the graphics card is at a high-end level, displaying the second refresh rate on the display for the user to select and deactivating an adaptive synchronization function.

In an embodiment, a machine-readable storage medium storing a program code operable to perform a display method is provided. The display method comprises using a graphics card to read extended display identification data of the display; determining that the display is able to display a default resolution at a first refresh rate at most; determining, according to the extended display identification data, whether the display is able to display the default resolution at a second refresh rate, wherein the second refresh rate exceeds the first refresh rate; and when it is determined that the display is able to display the default resolution at the second refresh rate, adding the second refresh rate into the extended display identification data.

According to an embodiment of the invention, the extended display identification data comprises the default resolution, the first refresh rate, and a transmission bandwidth. The step of determining, according to the extended display identification data, whether the display is able to display the default resolution at the second refresh rate further comprises calculating the second refresh rate using the transmission bandwidth and the default resolution; determining whether the second refresh rate exceeds the first refresh rate; and when the second refresh rate exceeds the first refresh rate, determining that the display is able to display the default resolution at the second refresh rate.

According to an embodiment of the invention, the extended display identification data is stored in a register of the display. After the step of adding the second refresh rate into the extended display identification data, the display method further comprises writing the updated extended display identification data into the register.

According to an embodiment of the invention, after the step of adding the second refresh rate into the extended display identification data, the display method further comprises determining a level of the graphics card; when it is determined that the graphics card is at an entry level, hiding the second refresh rate so that a user is not able to select the second refresh rate; and when it is determined that the graphics card is at an intermediate level, displaying the second refresh rate on the display for the user to select and activating an adaptive synchronization function.

According to another embodiment of the invention, the display method further comprises when it is determined that the graphics card is at a high-end level, displaying the second refresh rate on the display for the user to select and deactivating an adaptive synchronization function.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
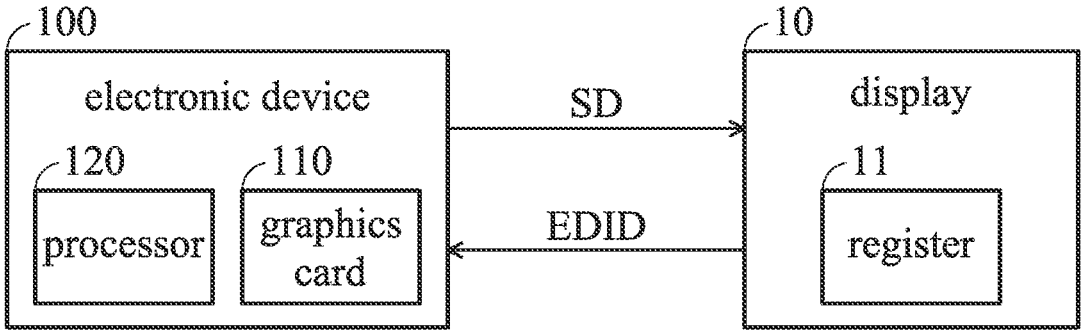
FIG. 1 is a block diagram of an electronic device in accordance with an embodiment of the invention.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It is understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of an electronic device in accordance with an embodiment of the invention. As shown in FIG. 1, the electronic device 100 includes a graphics card 110 and a processor 120, in which the electronic device 100 is coupled to a display 10. The graphics card 110 reads the extended display identification data EDID of the display 10, in which the extended display identification data EDID of the display 10 is stored in the register 11. According to an embodiment of the invention, the register 11 may be an electrically-erasable programmable read-only memory (EEPROM). According to an embodiment of the invention, when the display 10 is shipped, the default resolution, the default refresh rate, and the maximum transmission bandwidth of the display 10 would be written into the register 11 to be the extended display identification data EDID, in which the default resolution is the maximum resolution of the display 10.

When the graphics card 110 reads the extended display identification data EDID of the display 10, the processor 120 determines, according to the extended display identification data EDID of the display 10, that the display 10 is able to display the default resolution at the first refresh rate at most and determines, according to the extended display identification data EDID, whether the display 10 is able to display the default resolution at a second refresh rate that exceeds the first refresh rate. According to an embodiment of the invention, the first refresh rate is the maximum default refresh rate record in the extended display identification data EDID of the display 10 for displaying the default resolution.

When the processor 120 determines that the display 10 is able to display the default resolution at the second refresh rate, the processor 120 adds the second refresh rate into the extended display identification data EDID and writes the updated extended display identification data EDID into the register 11 of the display 10. When the user selects the second refresh rate displayed on the display 10, the graphics card 110 transmits the corresponding display signal SD to the display 10 so that the display 10 displays the default resolution at the second refresh rate.

Therefore, the user may display the default resolution at a higher refresh rate so as to have a better visual experience. According to an embodiment of the invention, the electronic device 100 is a computer. According to another embodiment of the invention, the electronic device 100 is a game console, such as PlayStation, Xbox, Switch, and any game console in the future which needs higher refresh rate. When the computer or the game console is coupled to a television or a display, it is determined, according to the extended display identification data EDID of the display 10, whether the default resolution can be displayed at a higher refresh rate so as to provide better visual experience for the user. The detailed flow of the electronic device 100 improving the refresh rate of the display 10 will be described in the following paragraphs.

Figure 2:
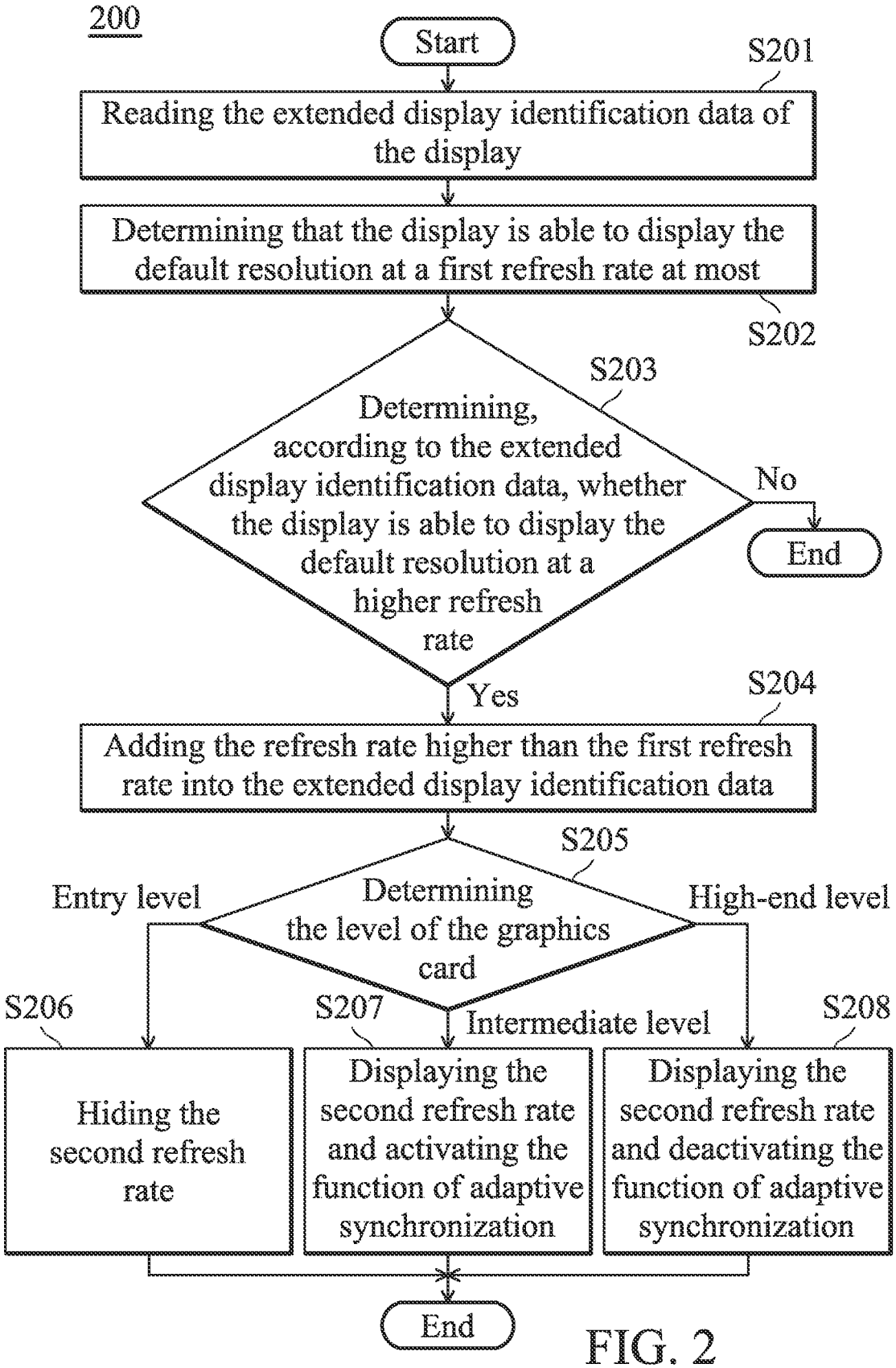
FIG. 2 is a flow chart of a display method in accordance with an embodiment of the invention.

FIG. 2 is a flow chart of a display method in accordance with an embodiment of the invention. The following description to the flow chart in FIG. 2 will be accompanied with the block diagram in FIG. 1 for explanation in more detailed.

As shown in FIG. 2, the extended display identification data EDID stored in the register 11 of the display 10 is read by the graphics card 110 (Step S201). According to the extended display identification data EDID that has been read, the processor 120 determines that the display 10 is able to display the default resolution at a first refresh rate at most (Step S202). According to an embodiment of the invention, the default resolution is the highest resolution of the display 10, and the first refresh rate is the maximum refresh rate of the display 10 for displaying the highest resolution.

Then, the processor 120 determines, according to the extended display identification data EDID, whether the display 10 is able to display the default resolution at a higher refresh rate (Step S203). More specifically, in Step S203, the processor 120 determines whether the display 10 is able to display the default resolution at a refresh rate higher than the first refresh rate. According to an embodiment of the invention, the extended display identification data EDID includes the default resolution, the first refresh rate, and the transmission bandwidth, in which the transmission bandwidth is the maximum bandwidth of the control panel of the timing controller.

When the processor 120 in Step S203 determines whether the default resolution is able to be displayed at a higher refresh rate, Eq. 1 is utilized to calculate the maximal allowable refresh rate (referred as the second refresh rate hereafter) of the display 10, in which R is the maximum refresh rate, BW is the transmission bandwidth, H is the horizontal pixels, V is the vertical pixels, and the transmission bandwidth, the horizontal pixels, and the vertical pixels are captured from the extended display identification data EDID.

$$R = \frac{BW}{H \times V} \quad \text{(Eq. 1)}$$

Then, the processor 120 determines whether the second refresh rate exceeds the first refresh rate. When the second refresh rate exceeds the first refresh rate, the processor 120 determines that the display 10 is able to display the default resolution at a higher refresh rate. When it is determined in Step S203 that the display 10 is able to display the default resolution at a higher refresh rate, the processor 120 adds the refresh rate higher than the first refresh rate, i.e., the second refresh rate, into the extended display identification data EDID (Step S204).

According to an embodiment of the invention, the processor 120 further writes the extended display identification data EDID updated in Step S204 into the register 11. According to an embodiment of the invention, when it is determined in Step S203 that the display 10 is not able to display the default resolution at a higher refresh rate, the display method 200 is completed.

Then, the processor 120 further determines the level of the graphics card 110 (Step S205). When the processor 120 determines that the graphics card 110 is at the entry level, the second refresh rate is hidden (Step S206) so that the user is not able to display the default resolution at the second refresh rate.

When it is determined in Step S205 that the graphics card 110 is at the intermediate level, the second refresh rate is displayed on the display 10 for the user to select, and the adaptive synchronization function is activated (Step S207). When it is determined that the graphics card 110 is at the high-end level, the second refresh rate is displayed on the display 10 for the user to select, and the adaptive synchronization function is deactivated (Step S208).

According to an embodiment of the invention, the processor 120 determines whether the serial number of the graphics card 110 is at the entry level, the intermediate level, or the high-end level by a lookup table. For example, the graphics card in nowadays is produced by Intel, NVIDIA, or AMD. When the processor 120 understands that the serial number of the graphics card 110 belongs to Intel, the processor 120 determines that the graphics card 110 is at the entry level so that the second refresh rate is hidden. According to an embodiment of the invention, in order to prevent the entry-level graphics card can't transmit data at a high refresh rate, the second refresh rate is hidden to prevent the user from poor visual experience.

According to another embodiment of the invention, when it is determined that the graphics card 110 is GTX 960 of NVIDIA, the processor 120 determines that the graphics card 110 is at the intermediate level so that the second refresh rate is displayed and the adaptive synchronization function is activated. According to an embodiment of the invention, when it is determined that the graphics card 110 is at the intermediate level, the adaptive synchronization function is automatically activated to prevent screen tearing and improve the user's visual experience.

According to another embodiment of the invention, when it is determined that the graphics card 110 is GTX 1080 of NVIDIA, the processor 120 determines that the graphics card is at the high-end level so that the second refresh rate is displayed and the adaptive synchronization function is deactivated. According to an embodiment of the invention, since the graphics card 110 is at the high-end level, regardless of whether the adaptive synchronization function is activated, the improvement of the screen may be limited. Therefore, the adaptive synchronization function is reserved for the user to control. The description above is merely for explanation, but not intended to be limited thereto.

Figure 3:
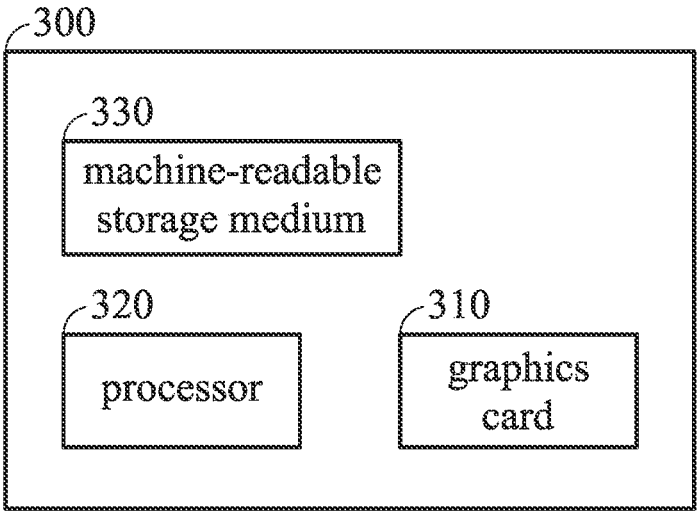
FIG. 3 is a block diagram of an electronic device in accordance with an embodiment of the invention.

FIG. 3 is a block diagram of an electronic device in accordance with an embodiment of the invention. As shown in FIG. 3, the electronic device 300 includes a graphics card 310, a processor 320, and a machine-readable storage medium 330, in which the graphics card 310 and the processor 320 correspond to the graphics card 110 and the processor 120 in FIG. 1 respectively.

The machine-readable storage medium 330 is configured to store a plurality of program code. When the processor 320 executes the program code stored in the machine-readable storage medium 330, the display method 200 in FIG. 2 is performed. The detailed operations of the display method 200 have been described as above, but not repeated herein.

According to an embodiment of the invention, the electronic device 300 is a computer. According to another embodiment of the invention, the electronic device 300 is a game console, such as PlayStation, Xbox, Switch, and any game console in the future which needs higher refresh rate. For example, when the computer or the game console is coupled to an old display or a television, the electronic device 300 may utilize the display method 200 to maximize the performance of the display or the television, thereby satisfying the user's visual experience to the greatest extent.

According to some embodiments of the invention, the machine-readable storage medium 330 includes, but not limited thereto, non-transitory, tangible arrangements of articles manufactured or formed by a machine or device, including machine-readable storage medium such as hard disks, any other type of disk including floppy disks, optical disks, compact disc read-only memory (CD-ROM), compact disc rewritable (CD-RW), and magneto-optical disks, as well as semiconductor devices such as read-only memory (ROM), random access memory (RAM), dynamic random access memory (DRAM), static random access memory (SRAM), erasable programmable read-only memory (EPROM), flash memory, electrically erasable programmable read-only memory (EEPROM), phase change memory (PCM), magnetic or optical cards, or any other type of medium suitable for storing electronic instructions.

The display method provided herein may also be embodied in the form of program code transmitted over some transmission medium, such as electrical wiring or cabling, through fiber optics, or via any other form of transmission, wherein, when the program code is received and loaded into and executed by a machine, such as a computer, the machine becomes an apparatus for practicing the disclosed methods. When implemented on a general-purpose processor, the program code combines with the processor to provide a unique apparatus that operates analogously to application specific logic circuits.

Electronic devices, display methods, and a machine-readable storage medium are provided herein, which are able to determine the margin of the display capability of a display, thereby enhancing the user's visual experience. Therefore, the user can enjoy a better visual experience despite limited resources.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An electronic device coupled to a display, comprising:

a graphics card, reading extended display identification data of the display;

a processor, determining, according to the extended display identification data, that the display is able to display a default resolution at a first refresh rate at most and determining, according to the extended display identification data, whether the display is able to display the default resolution at a second refresh rate, wherein the second refresh rate exceeds the first refresh rate, wherein when it is determined that the graphics card is at an entry level, the processor hides the second refresh rate so that a user is not able to select the second refresh rate.

2. The electronic device as defined in claim 1, wherein the extended display identification data is stored in a register of the display, wherein after the processor adds the second refresh rate into the extended display identification data, the processor further writes the updated extended display identification data into the register.

3. The electronic device as defined in claim 1, wherein the extended display identification data comprises the default resolution and a transmission bandwidth, and the processor calculates the second refresh rate using the transmission bandwidth and the default resolution and determines whether the second refresh rate exceeds the first refresh rate, wherein when the second refresh rate exceeds the first refresh rate, the processor determines that the display is able to display the default resolution at the second refresh rate.

4. The electronic device as defined in claim 1, wherein after the processor adds the second refresh rate into the extended display identification data, the processor further determines a level of the graphics card.

5. The electronic device as defined in claim 4, wherein when it is determined that the graphics card is at an intermediate level, the processor displays the second refresh rate on the display for a user to select and activates an adaptive synchronization function.

6. The electronic device as defined in claim 4, wherein when it is determined that the graphics card is at a high-end level, the processor displays the second refresh rate on the display for a user to select and deactivates an adaptive synchronization function.

7. The electronic device as defined in claim 1, wherein the electronic device is a computer.

8. The electronic device as defined in claim 1, wherein the electronic device is a game console.

9. A display method adapted to a display, comprising:

using a graphics card to read extended display identification data of the display;

determining that the display is able to display a default resolution at a first refresh rate at most;

determining, according to the extended display identification data, whether the display is able to display the default resolution at a second refresh rate, wherein the second refresh rate exceeds the first refresh rate; and when it is determined that the display is able to display the default resolution at the second refresh rate, adding the second refresh rate into the extended display identification data, wherein after the step of adding the second refresh rate into the extended display identification data, the display method further comprises:

determining a level of the graphics card; and when it is determined that the graphics card is at an entry level, hiding the second refresh rate so that a user is not able to select the second refresh rate.

10. The display method as defined in claim 9, wherein the extended display identification data is stored in a register of the display, wherein after the step of adding the second refresh rate into the extended display identification data, the display method further comprises:

writing the updated extended display identification data into the register.

11. The display method as defined in claim 9, wherein the extended display identification data comprises the default resolution, the first refresh rate, and a transmission bandwidth, wherein the step of determining, according to the extended display identification data, whether the display is able to display the default resolution at the second refresh rate further comprises:

calculating the second refresh rate using the transmission bandwidth and the default resolution;

determining whether the second refresh rate exceeds the first refresh rate; and when the second refresh rate exceeds the first refresh rate, determining that the display is able to display the default resolution at the second refresh rate.

12. The display method as defined in claim 9, wherein after the step of determining the level of the graphics card, the display method further comprises:

when it is determined that the graphics card is at an intermediate level, displaying the second refresh rate on the display for the user to select and activating an adaptive synchronization function.

13. The display method as defined in claim 9, wherein after the step of determining the level of the graphics card, the display method further comprises:

when it is determined that the graphics card is at a high-end level, displaying the second refresh rate on the display for the user to select and deactivating an adaptive synchronization function.

14. A machine-readable storage medium storing a program code operable to perform a display method, wherein the display method comprises:

using a graphics card to read the extended display identification data of the display;

determining that the display is able to display a default resolution at a first refresh rate at most;

determining, according to the extended display identification data, whether the display is able to display the default resolution at a second refresh rate, wherein the second refresh rate exceeds the first refresh rate; and when it is determined that the display is able to display the default resolution at the second refresh rate, adding the second refresh rate into the extended display identification data, wherein after the step of adding the second refresh rate into the extended display identification data, the display method further comprises:

determining a level of the graphics card; and when it is determined that the graphics card is at an entry level, hiding the second refresh rate so that a user is not able to select the second refresh rate.

15. The machine-readable storage medium as defined in claim 14, wherein the extended display identification data comprises the default resolution, the first refresh rate, and a transmission bandwidth, wherein the step of determining, according to the extended display identification data, whether the display is able to display the default resolution at the second refresh rate further comprises:

calculating the second refresh rate using the transmission bandwidth and the default resolution;

determining whether the second refresh rate exceeds the first refresh rate; and when the second refresh rate exceeds the first refresh rate, determining that the display is able to display the default resolution at the second refresh rate.

16. The machine-readable storage medium as defined in claim 14, wherein the extended display identification data is stored in a register of the display, wherein after the step of adding the second refresh rate into the extended display identification data, the display method further comprises:

writing the updated extended display identification data into the register.

17. The machine-readable storage medium as defined in claim 14, wherein after the step of adding the second refresh rate into the extended display identification data, the display method further comprises:

when it is determined that the graphics card is at an intermediate level, displaying the second refresh rate on the display for the user to select and activating an adaptive synchronization function.

18. The machine-readable storage medium as defined in claim 14, wherein the display method further comprises:

when it is determined that the graphics card is at a high-end level, displaying the second refresh rate on the display for the user to select and deactivating an adaptive synchronization function.

* * * * *